US005323832A

United States Patent [19]

Burrows

[11] Patent Number: 5,323,832

[45] Date of Patent: * Jun. 28, 1994

[54] VALVE ACTUATOR FOR A SOFT DRINK DISPENSER STATION

[75] Inventor: Bruce D. Burrows, Valencia, Calif.

[73] Assignee: Ebtech, Inc., Columbus, Ohio

[ * ] Notice: The portion of the term of this patent subsequent to Dec. 22, 2009 has been disclaimed.

[21] Appl. No.: 990,756

[22] Filed: Dec. 15, 1992

Related U.S. Application Data

[63] Continuation of Ser. No. 812,015, Dec. 23, 1991, Pat. No. 5,172,831.

[51] Int. Cl.[5] ..... B67B 7/00

[52] U.S. Cl. ..... 222/1; 222/129.1; 222/185; 222/481.5; 222/484; 222/504; 251/33

[58] Field of Search ..... 222/1-2, 222/57, 129.1-129.4, 185, 325, 479, 481.5, 482, 484, 522, 523, 525, 504, 509, 532, 537, 559, 640, 641; 251/30.1, 31, 33

[56] References Cited

U.S. PATENT DOCUMENTS

| | | | |
|---|---|---|---|
| 2,547,423 | 4/1951 | Wegman et al. | 222/129.2 |
| 3,295,723 | 1/1967 | Welty | 222/129.1 |
| 4,181,242 | 1/1980 | Zygiel et al. | 222/129.2 |
| 4,966,306 | 1/1990 | Credle, Jr. et al. | 222/129.2 |
| 5,121,855 | 6/1992 | Credle, Jr. | 222/129.2 |
| 5,133,482 | 7/1992 | Burrows et al. | 222/481.5 |
| 5,172,831 | 12/1992 | Burrows | 222/481.5 |
| 5,211,314 | 5/1993 | Burrows | 222/185 |

*Primary Examiner*—Andres Kashnikow
*Assistant Examiner*—Philippe Derakshani
*Attorney, Agent, or Firm*—Kelly, Bauersfeld & Lowry

[57] ABSTRACT

An improved valve actuator is provided to operate a liquid dispenser valve of the type used in a soft drink dispenser station or the like. The dispenser station includes a pressurized supply of carbonated water for regulated delivery through a water dispense conduit to a drinking cup or the like for mixture with a selected flavor syrup delivered to the cup from a syrup-containing bottle having the dispenser valve at the bottle neck for controlling syrup outflow. The valve actuator is mechanically connected to the dispenser valve and responds to pressure along the water dispense conduit at a position upstream of a flow restrictor to open the dispenser valve each time carbonated water is delivered through the conduit to the drinking cup. At the conclusion of water delivery, the valve actuator responds to decreased pressure along the water dispense conduit to return the dispenser valve to a closed position.

16 Claims, 3 Drawing Sheets

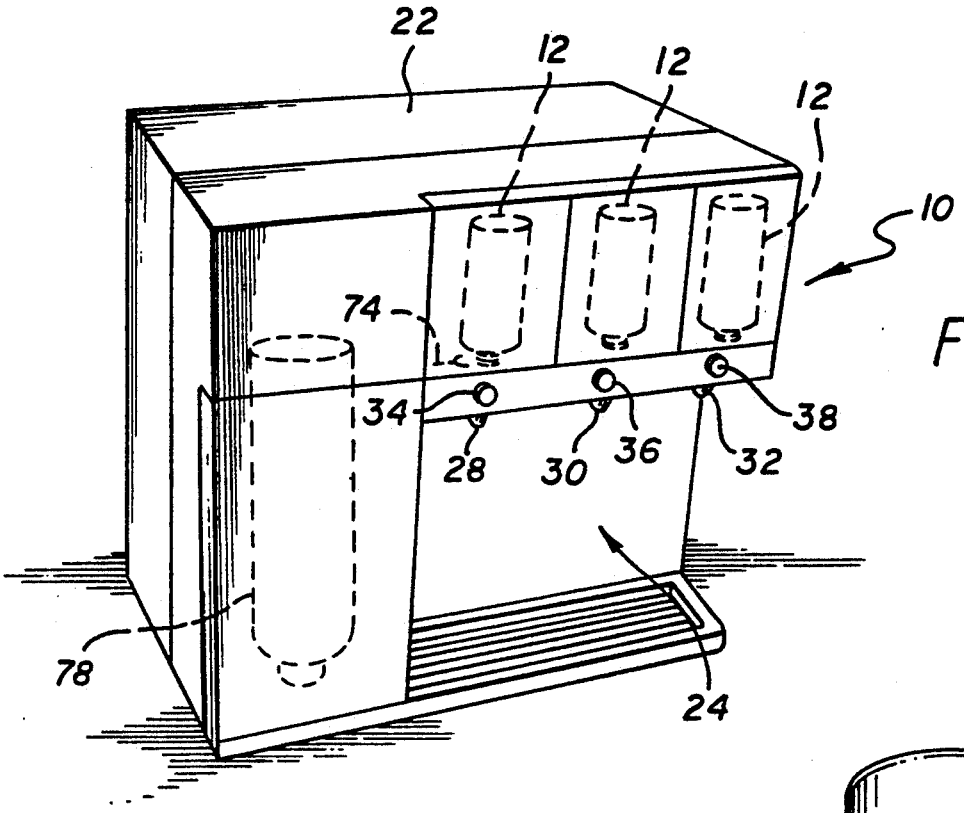
FIG. 1
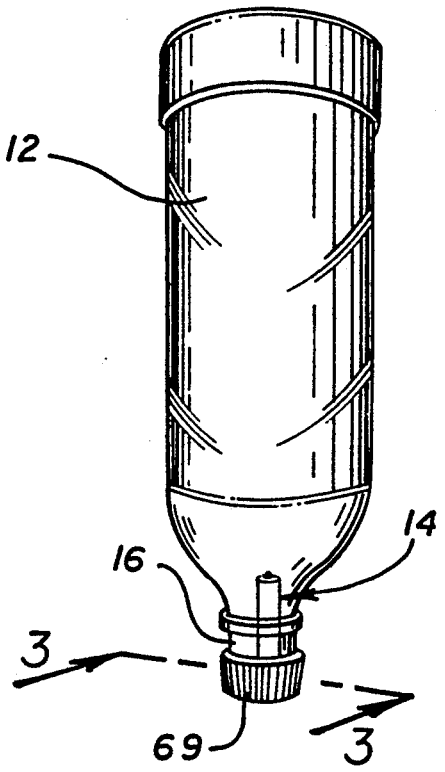
FIG. 2
FIG. 3
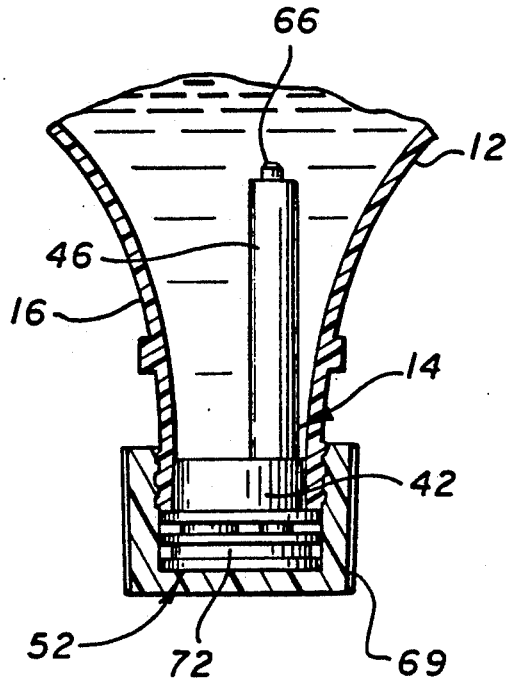

FIG. 4
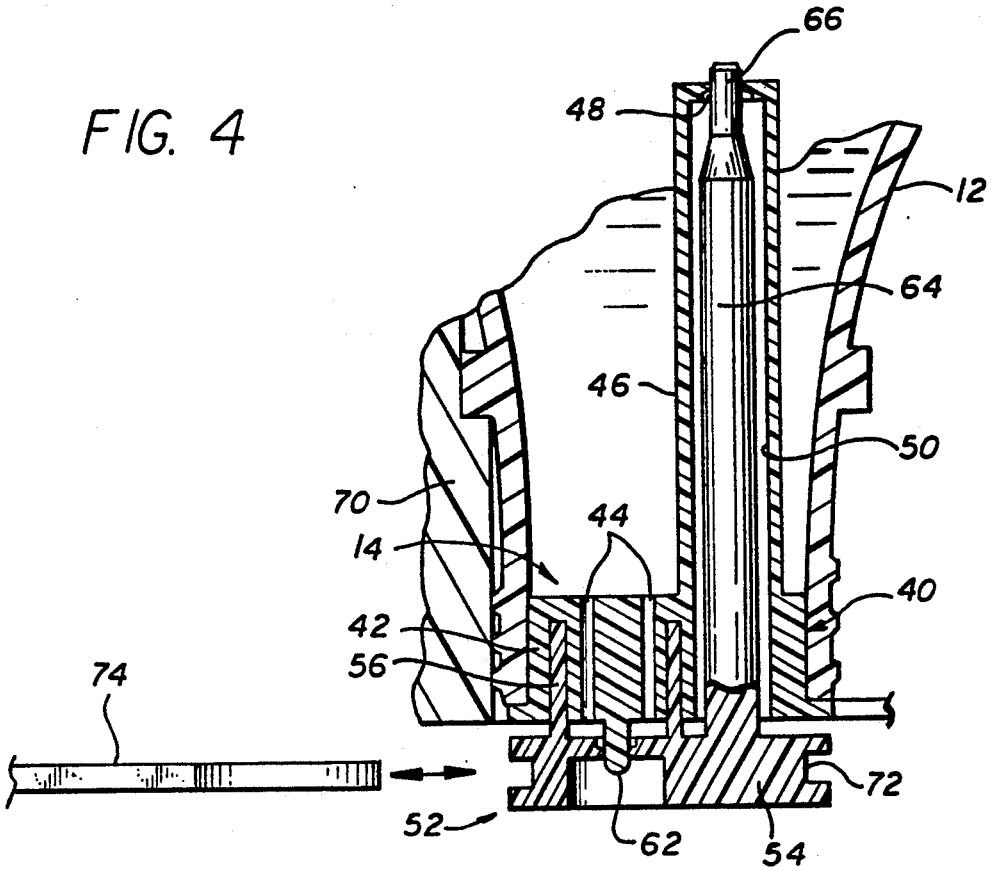
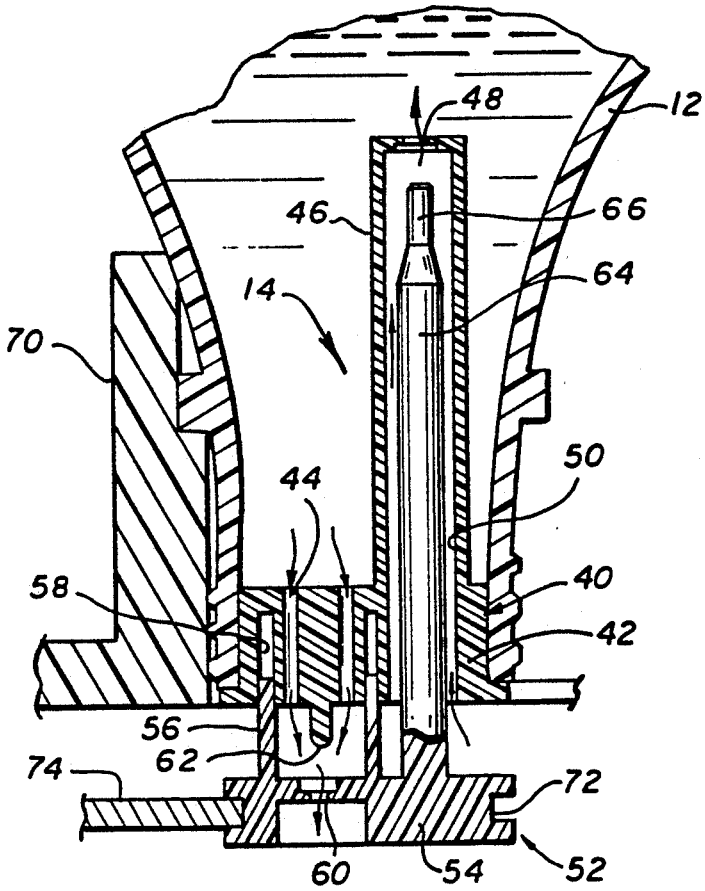
FIG. 5

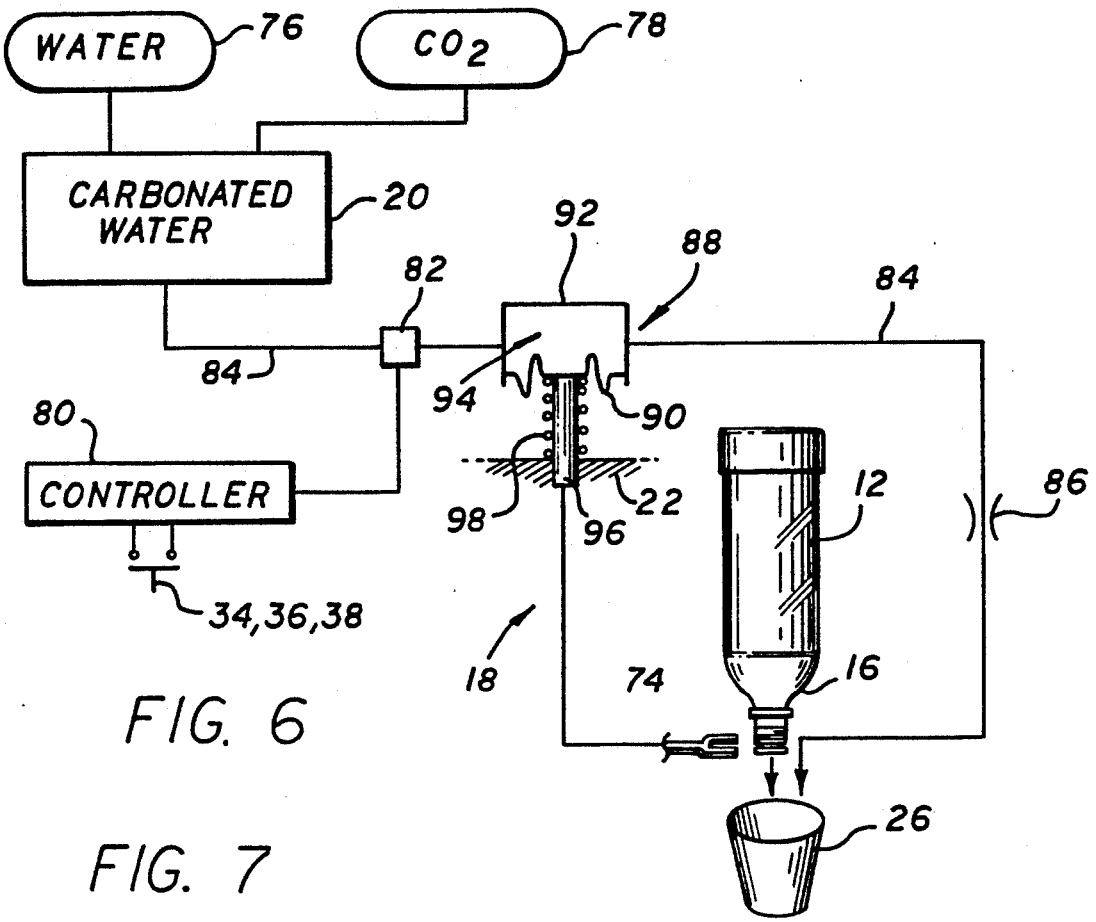
FIG. 6
FIG. 7
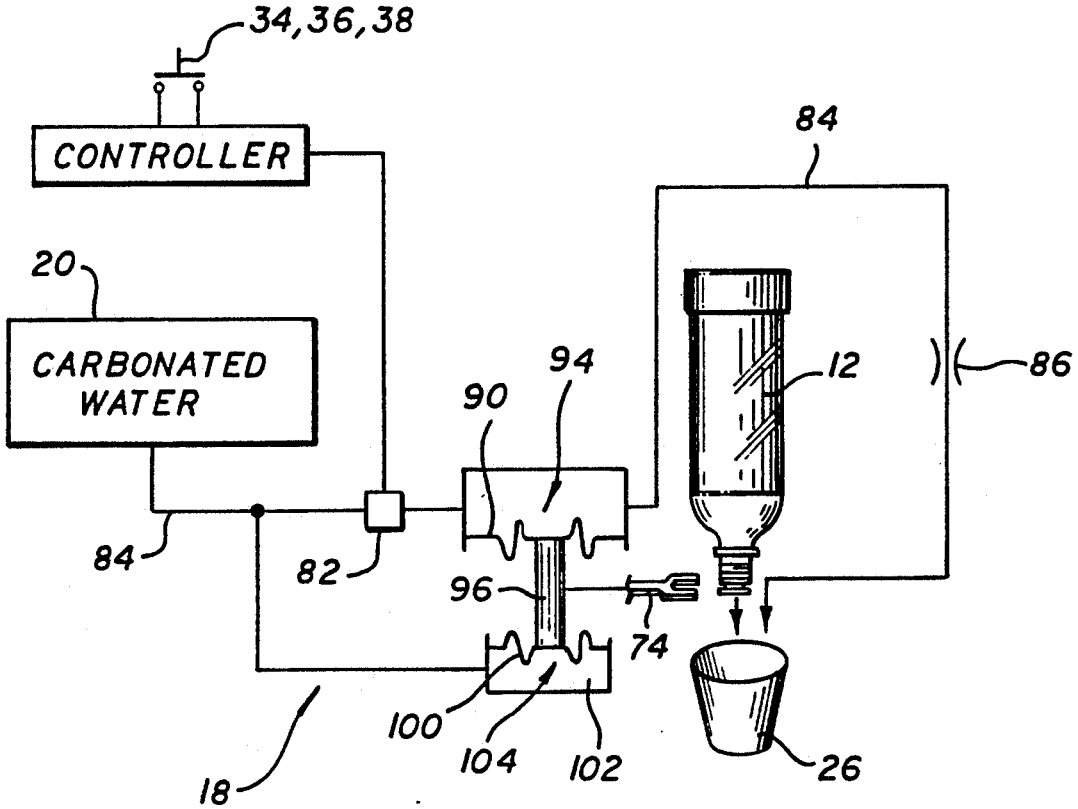

VALVE ACTUATOR FOR A SOFT DRINK DISPENSER STATION

This is a continuation of application Ser. No. 07/812,015, filed Dec. 23, 1991, now U.S. Pat. No. 5,172,831.

BACKGROUND OF THE INVENTION

This invention relates generally to dispensing valves and related valve actuator devices for use in regulated dispensing of liquids, particularly such as dispensing of flavor syrups and the like used in soft drink dispenser stations for mixing and dispensing soft drink beverages. More specifically, .this invention relates to an improved valve actuator adapted for hydraulic operation in response to delivery of carbonated water to operate a dispenser valve on a syrup-containing bottle, resulting in accurate delivery of proportioned quantities of syrup and carbonated water to produce a soft drink beverage.

Soft drink dispenser stations and/or vending machines and the like are generally known in the art for use in dispensing soft drink beverages in individual servings, typically on the order of about six to ten ounces per serving. Such dispenser stations commonly include a water reservoir adapted to receive and store a supply of fresh water typically in chilled and carbonated form, together with one or more separate bottles containing flavored syrup. When a beverage serving is desired, the dispenser station regulates the flow of proportioned quantities of the chilled water and the selected flavor syrup for mixture and dispensing into a drinking cup, glass, etc. Since the flavor syrup is normally provided in concentrated form, a relatively small volumetric proportion of the flavor syrup is delivered for each serving, in comparison with a significantly larger quantity of the chilled water. Accordingly, accurate delivery of closely regulated or metered volumes of the flavor syrup is extremely important to ensure dispensing of a consistent and high quality beverage product to the consumer. Relatively minor variations in the dispensed syrup quantity can unfortunately result in significant fluctuations in the taste of the final beverage.

In the past, soft drink dispenser stations and vending machines of this general type have utilized a variety of valve mechanisms and related valve actuators for controlled dispensing of carbonated water and/or the associated flavor syrup to form the soft drink beverage. In this regard, electrically operated valves have been widely used for regulating the water and syrup flows. However, this has generally required the use of separate valves associated with the water and syrup flows, with additional timer mechanisms and circuitry being required to insure accurate coordinated delivery of proportioned liquid quantities. In other systems, a pressurized supply of carbon dioxide gas used for producing carbonated water has additionally provided a pressure fluid for operating one or more pneumatic valve actuators. However, the carbon dioxide gas used to operate the valve mechanisms has been exhausted to atmosphere such that a significant portion of the pressurized gas supply is rendered unavailable for use in producing carbonated water.

The present invention overcomes the problems and disadvantages encountered in the prior art by providing an improved, relatively simple and economical valve actuator which is operated hydraulically by the pressurized supply of water in a soft drink dispenser station.

The improved valve actuator responds to dispensing of a portion of the water to correspondingly dispense the selected flavor syrup, thereby providing a simplified synchronism of water and flavor syrup flows to achieve accurate proportioned dispensing, without loss of carbon dioxide gas to atmosphere.

SUMMARY OF THE INVENTION

In accordance with the invention, an improved valve actuator is provided for use in a soft drink dispenser station of the type used to dispense proportioned .quantities of carbonated water and a selected flavor syrup to produce a soft drink beverage. The valve actuator is adapted for pressure responsive operation of a syrup dispenser valve, in response to dispensing of carbonated water to a receptacle such as a drinking cup or the like.

The soft drink dispenser station includes a pressurized supply of carbonated water within an appropriate storage reservoir, wherein this carbonated water supply is normally obtained by appropriate mixture of incoming water with carbon dioxide gas. In a typical soft drink dispenser station, the carbonated water supply is maintained at a pressure on the order of 55–60 psi. A water dispense valve which may be electrically operated permits flow of the carbonated water through a water dispense conduit to a drinking cup or the like. The duration of carbonated water flow is closely controlled to correspondingly select the quantity of carbonated water to be dispensed.

The valve actuator is mechanically linked to the dispenser valve on the syrup-containing bottle for moving the dispenser valve between open and closed positions. The valve actuator includes a pressure responsive element such as a resilient diaphragm subjected to the hydraulic pressure within the water dispense conduit at a position upstream from a flow restrictor and downstream from the water dispense valve. When carbonated water is dispensed through the conduit, the pressure responsive element is displaced by the pressure within said conduit to correspondingly displace the syrup dispenser valve to an open position. At the conclusion of carbonated water dispensing, the valve actuator responds to decreased pressure along the water conduit to return the syrup dispenser valve to the closed position.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a front perspective view of a soft drink dispenser station adapted to include the improved valve actuator embodying the novel features of the invention;

FIG. 2 is a perspective view depicting an exemplary flavor syrup bottle having a syrup dispenser valve mounted thereon;

FIG. 3 is an enlarged fragmented perspective view taken generally on the line 3—3 of FIG. 2;

FIG. 4 is an enlarged fragmented sectional view generally similar to FIG. 3 and illustrating the syrup dispenser valve in a closed condition;

FIG. 5 is a fragmented vertical sectional view similar to FIG. 4, and depicting the dispenser valve in an open condition;

FIG. 6 is a schematic diagram illustrating a preferred valve actuator in operative association with the syrup-containing bottle and associated dispenser valve; and FIG. 7 is a schematic diagram depicting an alternative preferred form of the invention.

DETAILED DESCRIPTION OF THE PREFERRED EMBODIMENTS

As shown in the exemplary drawings, a soft drink dispenser station referred to generally in FIG. 1 by the reference numeral 10 includes one or more relatively small bottles 12 containing flavor syrup for use in making soft drink beverages. As shown in FIGS. 2–5, each of the syrup-containing bottles 12 includes a relatively compact syrup dispenser valve 14 mounted directly into the bottle neck 16, wherein the dispenser valve 14 is designed for closely and accurately regulating syrup dispensing flow from the bottle 12 during normal operation of the dispenser station. An improved valve actuator 18 ( FIG. 6) is provided in accordance with the present invention for utilizing a pressurized supply 20 of carbonated water to hydraulically operate the dispenser valve actuator 14 associated with each syrup-containing bottle 12.

More particularly, the illustrative soft drink dispenser station 10 shown in FIG. 1 is constructed generally in a manner known in the art to include a station housing 22 which may be sized and shaped for a convenient compact countertop installation. The exemplary housing 22 defines a forwardly open receptacle 24 for receiving a drinking cup 26 (FIGS. 6 and 7) or the like in a filling position disposed immediately below any one of three separate dispensing nozzles 28, 30 and 32. These dispensing nozzles 28, 30 and 32 are respectively associated with a corresponding number of the syrup-containing bottles 12 adapted for removable mounting within the station housing 22. In addition, the dispensing nozzles are further associated with individual dispense actuators such as the illustrative dispense buttons 34, 36 and 38. Depression of one of the dispense buttons 34, 36, and 38 initiates station operation in a manner delivering and mixing proportioned quantities of the flavor syrup from the selected bottle 12 and chilled carbonated water from the water reservoir 20 (FIGS. 6 and 7) within the station housing. For a further and more detailed discussion of soft drink dispenser stations of this general type, see copending application Ser. No. 562,244, now U.S. Pat. No. 5,071,595 which is incorporated by reference herein. Moreover, although the illustrative drawings show a countertop size dispenser station 10 and relatively small volume syrup-containing bottles, it will be understood that the invention is equally applicable to dispenser stations and other fluid dispense apparatus of various size and type.

The improved valve actuator 18 of the present invention provides a simple and efficient system and method for coordinated dispensing of proportioned quantities of carbonated water and the selected flavor syrup to form the soft drink beverage. The valve actuator responds to the pressure of the carbonated water supply at the time of water dispensing for correspondingly operating the syrup dispenser valve 14 on the selected syrup flavor bottle 12. In the preferred form, the portion of the carbonated water supply utilized to operate the valve actuator 18 comprises the same water portion delivered to the drinking cup 26 for mixture with the flavor syrup.

Although the specific construction of the syrup dispenser valve 14 associated with each bottle 12 may vary, a preferred dispenser valve is shown in FIGS. 2–4 to have a construction corresponding with the dispenser valve described and shown in copending U.S. Ser. No. 813,782, filed Dec. 27, 1991, now U.S. Pat. No. 5,211,314 1991, and entitled SYRUP DISPENSER AND VALVE ASSEMBLY, which is incorporated by reference herein. More particularly, by way of brief description for purposes of clarity, the illustrative dispenser valve 14 comprises a base member 40 having a base plate 42 mounted directly within the neck 16 of a syrup-containing bottle 12. The base plate 42 has a plurality of syrup flow apertures 44 formed therein for downward syrup flow from the bottle when said bottle is installed into the station housing 22 in an inverted position. In addition, the base member 40 includes a vent tube 46 projecting from the base plate 42 in an inboard direction a shoe distance into the interior of the syrup bottle 12, and defining a distal or free end having an air vent port 48 formed therein. The base plate 42 and vent tube 46 cooperatively define an air vent passage 50 for admitting air into the bottle interior as a replacement for a dispensed syrup volume, as will be described in more detail.

The dispenser valve 14 additionally includes a movable valve member 52 having a disk-shaped valve plate 54 mounted at the outboard side of the base member 40. A cylindrical sealing sleeve 56 projects from the valve plate 54 for sealed sliding reception into an annular sealing channel 58 formed in an outboard face of the base plate 42, and in a position circumscribing the syrup flow apertures 44. A syrup dispense port 60 in the valve plate 54 is positioned for sealed reception of a post-shaped syrup valve head 62 on the base plate 42. An elongated valve stem 64 is also formed on the valve plate 54 and projects through the air vent passage 50 to a distal or free end defining a vent valve head 66 for closing the vent port 48.

The above-described syrup dispenser valve 14 is conveniently designed to be covered and protected by a standard bottle cap 69 ( FIGS. 2 and 3) until the syrup-containing bottle 12 is ready for use in the dispenser station 10. When use is desired, the bottle cap 69 is removed and the bottle 12 is installed into an appropriate support socket 70 (FIGS. 4 and. 5) within the station housing 22. In this mounted position, an external peripheral slot 72 formed in the valve plate 54 is positioned for operative engagement by a yoke member 74 forming a mechanical output link of the valve actuator 18. In operation, as will be described, the yoke member 74 controllably displaces the valve member 52 between a first position shown in FIG. 4 with the syrup and vent valve heads 62 and 66 closing the dispense and vent ports 60 and 48, to a second position as viewed in FIG. 5 with the valve heads and ports respectively retracted from each other to permit syrup outflow and bottle venting.

FIG. 6 is a schematic diagram illustrating the valve actuator 18 associated with one of the syrup-containing bottles, and depicting system operation for proportionate dispensing of carbonated water and the flavor syrup. More particularly, the carbonated water reservoir 20 receives an incoming supply of water from a tap water supply 76 or the like, and carbon dioxide gas from a suitable pressurized cartridge 78 or the like of a type known in the art. Depression of a selected one of the dispense buttons 34, 36 and 38 operates a station controller 80 to open a water dispense valve 82 for a prescribed time period, and then to automatically close the dispense valve. As shown in FIG. 6, the water dispense valve 82 is mounted along a water dispense conduit 84 leading from the carbonated water reservoir 20 to the drinking cup 26. Accordingly, opening of the water dispense valve 82 for a prescribed time period is effective to deliver a predetermined volume of the carbonated water to the cup 26.

The carbonated water supply is maintained under pressure typically on the order of about 55 to 60 psi, to maintain the carbon dioxide gas in solution. A flow restrictor 86 is mounted along the water dispense conduit 84 at a position spaced downstream from the water dispense valve 82 to maintain the water pressure through at least a portion of the dispense conduit 84 as the water flows to the drinking cup 26. A pressure responsive member 88 forming a portion of the valve actuator 18 is mounted along the water dispense conduit 84 at a position between the water dispense valve 82 and the flow restrictor 86 for pressure responsive operation of the syrup dispenser valve 14 on the bottle 12.

FIG. 6 shows the pressure responsive member 88 in one preferred form to include a resilient diaphragm 90 forming one wall of an actuator housing 92 defining an internal pressure chamber 94 disposed in-line with the water dispense conduit 84. An output arm 96 is connected to the diaphragm 90 and mechanically linked in turn to the yoke member 74 for displacing the yoke member 74 in response to pressure within the pressure chamber 94. A spring 98 reacts between a portion of the station housing 22 and the diaphragm 90 to bias the output arm 96 and the associated yoke member 74 toward a normal position closing the bottle to syrup outflow, as viewed in FIG. 4.

When the water dispense valve 82 is opened, as previously described, carbonated water flows into and through the pressure chamber 94 of the actuator housing 92 sufficiently raises the chamber pressure to displace the output arm 96 and associated yoke member 74 to a position opening the syrup dispenser valve 14, as view in FIG. 5. Thus, dispensing of the carbonated water through the water dispenser conduit 84 is effective to hydraulically operate the syrup dispense valve 14 to correspondingly dispense syrup for the same prescribed time interval. When the water dispense valve 82 is closed by the controller 80, as previously described, the pressure level within the actuator housing 92 promptly decreases to permit spring-urged return of the syrup dispenser valve 14 to the closed position. In this way, a single control valve 82 is operated by the controller 80, yet concurrent regulation of a second liquid in the form of the syrup is also obtained to achieve accurate proportioned mixture of syrup and carbonated water.

FIG. 7 illustrates an alternative preferred form of the invention, wherein components corresponding with those previously described in FIGS. 6 are referenced by common numerals. In this alternative embodiment, a modified valve actuator 18 includes an output arm 96 and associated yoke member 74 connected between a pair of resilient diaphragms 90 and 100 of differential size area. The diaphragm 90 forms a movable wall associated with a pressure chamber 94 disposed along the water dispense conduit 84, as previously described. The second diaphragm 100 has a smaller size area and forms a movable wall at one side of a secondary housing 102 forming a secondary pressure chamber 104 connected to the water dispense conduit 84 at a point upstream from the dispense valve 82. With this configuration, the pressure of the carbonated water supply 20 is normally applied to the secondary pressure chamber 104 to maintain the syrup dispenser valve 14 in a closed condition, when the water dispense valve 82 is closed. However, when the dispense valve 82 is opened and the pressure within the actuator housing 92 is increased, the increased pressure overcomes the closure force provided by the pressure within the secondary housing 102 to open the syrup dispenser valve 14 during water dispensing. When water dispensing ceases upon reclosure of the water dispense valve 82, as previously described, the pressure within the secondary housing 102 again returns the syrup dispenser valve 14 to the closed position.

The improved valve actuator of the present invention thus provides for accurate hydraulic operation of a syrup dispenser valve in response to timed delivery of carbonated water to a drinking cup or other receptacle. The carbonated water under pressure is used as the hydraulic medium for operating the syrup dispenser valve in a manner achieving accurate proportioned quantities of the two liquids. Importantly, the carbonated water is not wasted but is instead dispensed to the drinking cup to form part of the soft drink beverage.

A variety of further modifications and improvements to the present invention will be apparent to those skilled in the art. Accordingly, no limitation on the invention is intended by way of the foregoing description and accompanying drawings, except as set forth in the appended claims.

What is claimed is:

1. In a beverage dispenser station having a reservoir containing a supply of water under pressure, a water dispense conduit for flow passage of the water from said reservoir to a receptacle, a water dispense valve for controlling water outflow from said reservoir through said water dispense conduit, a bottle containing a supply of a selected flavor syrup, and a syrup dispenser valve for controlling syrup outflow from said bottle to said receptacle, a valve actuator comprising:

an actuator member engageable with said syrup dispenser valve to displace said syrup dispenser valve between closed and open positions for respectively preventing and permitting syrup outflow from said bottle; and means responsive to flow of the water through said water dispense conduit to displace said actuator member to a first position moving said syrup dispenser valve to said open position during water flow through said water dispense conduit, and to displace said actuator member to a second position moving said syrup dispenser valve to said closed position in the absence of water flow through said water dispense conduit.

2. The valve actuator of claim 1 further including a flow restrictor disposed along said water dispense conduit, said means responsive to flow of water through said water dispense conduit comprising a pressure responsive element responsive to fluid pressure along said water dispense conduit at a location upstream from said flow restrictor.

3. The valve actuator of claim 2 wherein said flow restrictor is disposed along said water dispense conduit at a position downstream from said water dispense valve.

4. The valve actuator of claim 2 wherein said pressure responsive element comprises a resilient diaphragm responsive to fluid pressure along said water dispense conduit during water flow therethrough to displace said actuator member to said first position.

5. The valve actuator of claim 4 further including spring means for normally biasing said actuator member to said second position in the absence of water flow through said water dispense conduit.

6. The valve actuator of claim 4 wherein said diaphragm comprises a first resilient diaphragm having a first area, and further including a second resilient diaphragm having a second and relatively smaller area subjected to the fluid pressure within said reservoir and coupled to said actuator member to normally bias said actuator member to said second position in the absence of water flow through said water dispense conduit.

7. The valve actuator of claim 1 further including control means for opening said water dispense valve for a predetermined time interval.

8. The valve actuator of claim 1 wherein the supply of water under pressure is a supply of carbonated water.

9. In a beverage dispenser station having a reservoir containing a supply of water under pressure, a water dispense conduit for flow passage of the water from said reservoir to a receptacle, a water dispense valve for controlling water outflow from said reservoir through said water dispense conduit, a bottle containing a supply of a selected flavor syrup, and a syrup dispenser valve for controlling syrup outflow from said bottle to said receptacle, a method of operating the syrup dispenser valve in coordination with the water dispense valve, said method comprising the steps of:

engaging the syrup dispenser valve with an actuator member;

responding to flow of water along the water dispense conduit using a pressure responsive element to displace the actuator member to a first position moving the syrup dispenser valve to the open position; and responding to the absence of flow of water along the water dispense conduit using said pressure responsive element displace the actuator member to a second position moving the syrup dispenser valve to the closed position.

10. The method of claim 9 further including the step of restricting carbonated water flow at a selected point along the water dispense conduit during water flow through the water dispense conduit, said flow responding steps comprising the steps of responding to fluid pressure along the water dispense conduit at a location upstream from the selected restriction point.

11. The method of claim 9 further including the step of opening the water dispense valve for a predetermined time interval.

12. In a beverage dispenser station having a water flow conduit for flow passage of a supply of water under pressure, a bottle containing a supply of a selected flavor syrup, and a syrup dispenser valve for controlling syrup outflow from said bottle to a receptacle, a valve actuator comprising:

an actuator member engageable with said syrup dispenser valve to displace said syrup dispenser valve between closed and open positions for respectively preventing said permitting syrup outflow from said bottle; and means responsive to flow of the water through said water flow conduit to displace said actuator member to a first position moving said syrup dispenser valve to said open position during water flow through said water flow conduit, and to displace said actuator member to a second position moving said syrup dispenser valve to said closed position in the absence of water flow through said water flow conduit.

13. The valve actuator of claim 12 further including a flow restrictor disposed along said water flow conduit, said means responsive to flow of water through said water flow conduit comprising a pressure responsive element responsive to fluid pressure along said water flow conduit at a location upstream from said flow restrictor.

14. The valve actuator of claim 13 wherein said pressure responsive element comprises a resilient diaphragm responsive to fluid pressure along said water flow conduit during water flow therethrough to displace said actuator member to said first position.

15. The valve actuator of claim 14 further including spring means for normally biasing said actuator member to said second position in the absence of water flow through said water flow conduit.

16. In a beverage dispenser station having a water flow conduit for flow passage of a supply of water under pressure, a bottle containing a supply of a selected flavor syrup, and a syrup dispenser valve for controlling syrup outflow from said bottle to a receptacle, a method of operation the syrup dispenser valve in coordination with the flow passage of said method comprising the steps of:

engaging the syrup dispenser valve with an actuator member;

responding to flow of water through the water flow conduit using a pressure responsive element to displace the actuator member to a first position moving the syrup dispenser valve to the open position; and responding to the absence of flow of water along the water flow conduit using said pressure responsive element to displace the actuator member to a second position moving the syrup dispenser valve to the closed position.

* * * * *